US005287636A

United States Patent [19]

Lafleur et al.

[11] Patent Number: 5,287,636

[45] Date of Patent: Feb. 22, 1994

[54] TUBULAR DRYING APPARATUS FOR FOOTWEAR OR HANDWEAR

[75] Inventors: André Lafleur, Boucherville; Réal Lanoix, Laval, both of Canada

[73] Assignees: Colette Laferriere, St-Lambert-de-Lévis; Lise Laferriere, St-Georges-de-Windsor, both of Canada

[21] Appl. No.: 8,133

[22] Filed: Jan. 25, 1993

[51] Int. Cl.[5] ..... F26B 25/00

[52] U.S. Cl. ..... 34/104; 34/239; 239/565

[58] Field of Search ..... 34/90, 91, 106, 105, 34/104, 239, 240, 21, 107; 239/565

[56] References Cited

U.S. PATENT DOCUMENTS

| | | | |
|---|---|---|---|
| 386,746 | 7/1888 | Hess | 34/104 |
| 426,111 | 4/1890 | Coffin | 34/104 |
| 680,264 | 8/1901 | Mansfield | 34/104 |
| 686,314 | 11/1901 | Mansfield . | |
| 2,443,695 | 6/1948 | Russell | 34/104 |
| 2,444,195 | 6/1948 | Gruver | 34/104 |
| 2,465,362 | 3/1949 | Elliott | 34/104 |
| 3,154,392 | 10/1964 | Littman | 34/104 |
| 3,203,112 | 8/1965 | Edmonds | 34/104 |
| 3,417,482 | 12/1968 | Peet | 34/104 |
| 3,513,564 | 5/1970 | Gramprie | 34/104 |
| 3,645,009 | 2/1972 | Ketchum | 34/104 |
| 3,793,744 | 2/1974 | Saita | 34/104 |
| 4,136,464 | 1/1979 | Hay | 34/104 |
| 4,171,580 | 10/1979 | Vabrinskas | 34/104 |
| 4,200,993 | 5/1980 | Blanc et al. | 34/104 |
| 4,265,030 | 5/1981 | Smallegan | 34/239 |
| 4,596,078 | 6/1986 | McCartney | 34/104 |
| 4,727,656 | 3/1988 | Jannach et al. | 34/104 |
| 4,768,293 | 9/1988 | Kaffka | 34/104 |
| 4,787,153 | 11/1988 | Chen | 34/104 |
| 4,967,060 | 10/1990 | Lomeli | 34/104 |

FOREIGN PATENT DOCUMENTS

| | | |
|---|---|---|
| 125338 | 4/1910 | Canada . |
| 243303 | of 1924 | Canada . |
| 266465 | of 1926 | Canada . |
| 753404 | 2/1967 | Canada . |
| 825284 | 10/1969 | Canada . |
| 880995 | of 1971 | Canada . |
| 1103019 | of 1981 | Canada . |
| 1256283 | of 1989 | Canada . |

*Primary Examiner*—Henry A. Bennet
*Assistant Examiner*—Denise Gromada
*Attorney, Agent, or Firm*—ROBIC

[57] ABSTRACT

The dryer comprises a plurality of extendible air conducting tubes each of which is independently pivotally connected to the hot air supply, in order to dry footwear while the footwear is resting on the floor and being partly supported by the tube, and the tubes may be directed upwardly to support handwear. The tubes are provided with air flow controlling nozzles which adjust the flow of air by rotating a cap member. The cap member has air outlet slits on diametrically opposed sides with more slits blowing air towards a toe of the footwear than towards a heel. Turning the cap to block the air flow is done when any given tube is not required for footwear or handwear drying.

16 Claims, 3 Drawing Sheets

FIG. 3
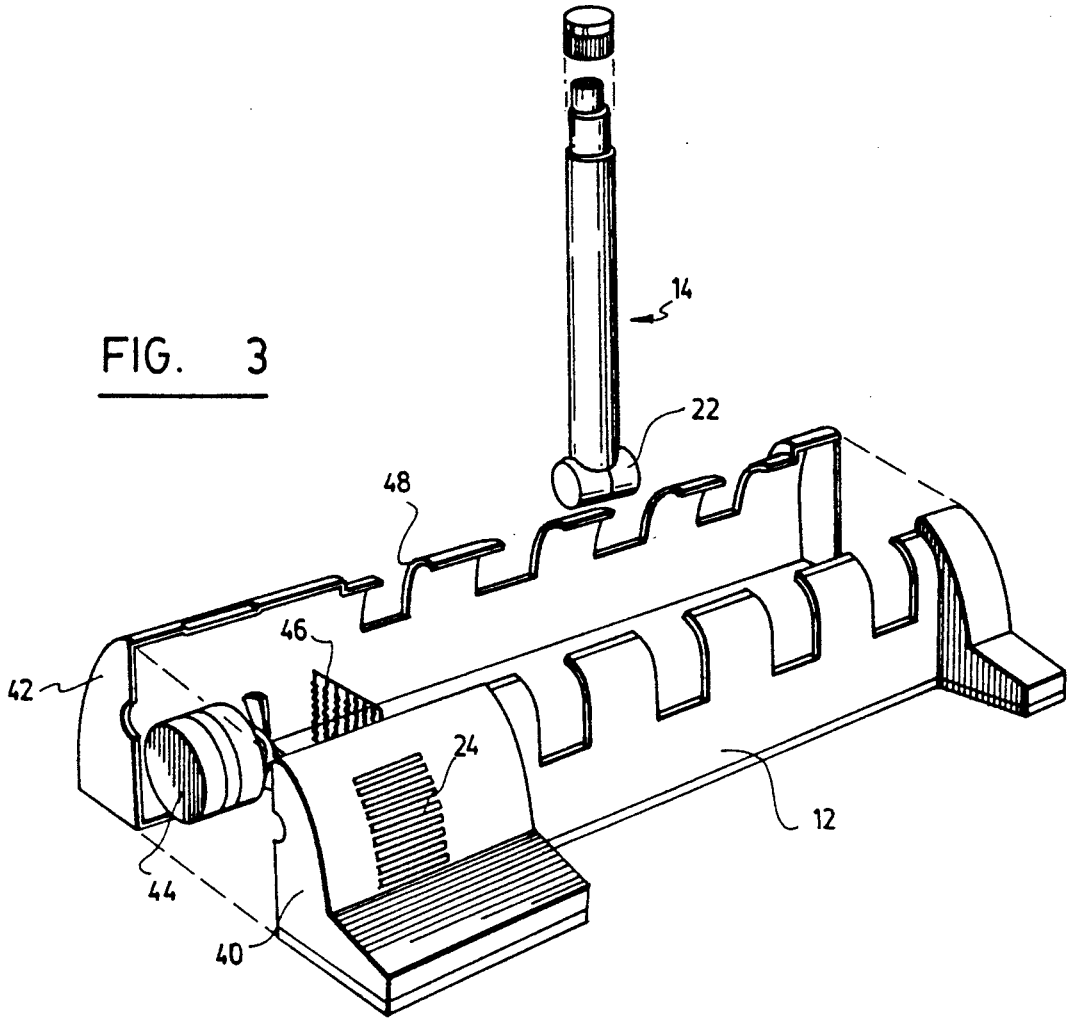
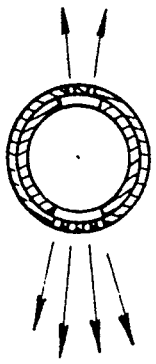
FIG. 5
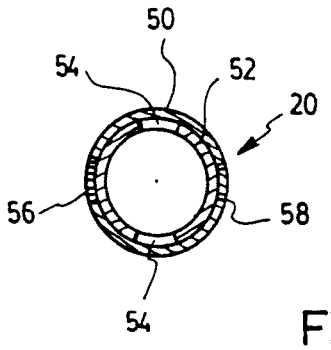
FIG. 6

TUBULAR DRYING APPARATUS FOR FOOTWEAR OR HANDWEAR

FIELD OF THE INVENTION

The present invention relates to a drying apparatus for footwear or handwear.

BACKGROUND OF THE INVENTION

The prior art in the area of devices for drying shoes and boots is extensive. These devices comprise a supply of hot air for drying the footwear and at least one air conducting tube for guiding the air into the shoe, and more importantly distributing the air toward the toe of the footwear where drying is usually more difficult.

Examples of such devices are given in U.S. Pat. Nos. 3,417,482, 3,793,744, 4,136,464 and 4,768,293. In particular, U.S. patent 4,136,464 discloses a boot drying apparatus having a plurality of upright extending tubes having a snout-like portion pointed in one direction to blow air into the toe of the boot. When a boot is inverted and placed on a given tube, it depresses a rod which opens the connection between the tube and the hot air source. In this way, hot air is supplied only to those tubes where boots are being dried. In U.S. Pat. No. 3,793,744, a device for drying shoes is disclosed in which an L-shaped perforate nozzle tube is inserted into each shoe which is to be dried. Several nozzle tubes may be connected to a single hot air supply, and it is additionally possible to make the placing of the shoe on a nozzle tube open a flap valve connecting the tube to the air supply. The shoes are placed upright onto the nozzle tubes. U.S. Pat. No. 4,768,293 discloses a footwear drying apparatus which plugs into an open or ankle portion of the footwear while the footwear is resting on the floor. A telescopic tube extends from the ankle portion to the sole and air is blown mostly towards the toe with some air being blown towards the heel. U.S. Pat. No. 4,787,153 discloses a shoe or slipper dryer which has two air conducting tubes to be inserted into the toes of the shoes with the shoes pointing vertically. The tubes are rotatably mounted together to the base and may be rotated down to be flush with the base for compact storage. A convenient timer for timing the drying process is also provided.

In the prior art footwear dryers, individual adjustment of the position of the air conducting tubes and of the air flow through each nozzle was not provided in any convenient manner. Dryers having several air conducting tubes have not been able to adjust to the specific dimensions and drying air flow requirements of various types of footwear. It is also common in the prior art that the footwear is to be placed upside down over the air conducting tube such that the air conducting tube fully supports the footwear in the upside down position. In this arrangement ice or snow which has stuck to the footwear sole will melt and run down the sides of the footwear and onto the dryer.

OBJECTS OF THE INVENTION

It is an object of the present invention to overcome the above-mentioned drawbacks. In particular, it is an object of the invention to provide a footwear drying apparatus in which the air flow through the nozzles of individual air conducting tubes is controllable from no air flow to a maximum air flow. It is another object of the present invention to provide a footwear drying apparatus in which the air conducting tubes pivotally project from a base and can be angled such that the footwear rests with the sole on the floor with the ankle or the leg portion of the footwear being supported if need be by the conducting tube.

According to the invention there is provided a footwear drying apparatus comprising a hot air supply, a plurality of air conducting tubes connected to the hot air supply for conducting hot air into footwear, and a plurality of nozzles provided at ends of the tubes, the nozzles having at least two outlets substantially diametrically opposed for blowing air in a first direction towards a toe of the footwear and in a second opposite direction towards a heel of the footwear, the outlets providing substantially more air flow towards the toe than towards the heel, the nozzles each comprising a fixed member fixed with respect to the nozzles and an adjacent rotating member rotatable with respect to the tubes, the outlets being provided by an intersection of corresponding openings in each fixed member and each rotating member, rotation of the rotating member reducing said intersection to zero, whereby by rotating the rotating member of any one of said nozzles, air flow can be controlled from no air flow to maximum air flow.

There is also provided according to the invention a footwear drying apparatus comprising a hot air supply, a base having a plurality of coaxial tube connectors connected to the supply, a plurality of air conducting tubes independently pivotable about a common axis and each comprising a cylindrical socket pivotally connected to a corresponding one of the connectors, a telescopic member connected to the socket, and an outlet nozzle connected to the telescopic member, whereby when the base is floor mounted, the tubes may be pivoted upwardly when not in use and substantially horizontally with the second telescopic member fully extended in the footwear with the footwear resting on the floor when in use, and when the base is wall mounted, the tubes may be pivoted toward the wall when not in use and may be pivoted away from the wall to place the footwear and then lowered with the footwear until the footwear rests on the floor when in use.

Preferably, the air conducting tubes are cylindrical and telescopic. The rotating member is preferably a cylindrical cap placed on the end of the air conducting tubes with a plurality of slits for directing air towards the toe and at least one slit for directing air towards the heel, the end of the air conducting tubes having U-shaped indentations providing openings which correspond to the slits such that a relatively small rotation of the cap controls the air flow from no air flow to maximum air flow.

Also, preferably the base is made of a two-part assembly which houses an electric fan and heating element for supplying hot air to the cylindrical sockets. Preferably the air conducting tubes may be oriented upwardly when drying mittens and gloves, and the air conducting tubes may be directed toward a waterproof floor mat and inserted into footwear when drying snow covered footwear.

BRIEF DESCRIPTION OF THE DRAWINGS

The invention will be better understood by way of the following non-limiting description of a preferred embodiment of the invention with reference to the appended drawings in which:

FIG. 3 is an exploded perspective view of the preferred embodiment showing details of the two-part housing;

FIG. 5, appearing on the same drawing sheet as FIG. 3, is a cross-sectional view of the nozzle according to the preferred embodiment in the open position showing in ghost lines a boot position thereover; and FIG. 6, appearing on the same drawing sheet as FIG. 3, is a cross-sectional view of the nozzle according to the preferred embodiment in the closed position.

DETAILED DESCRIPTION OF THE PREFERRED EMBODIMENT

Figure 1:
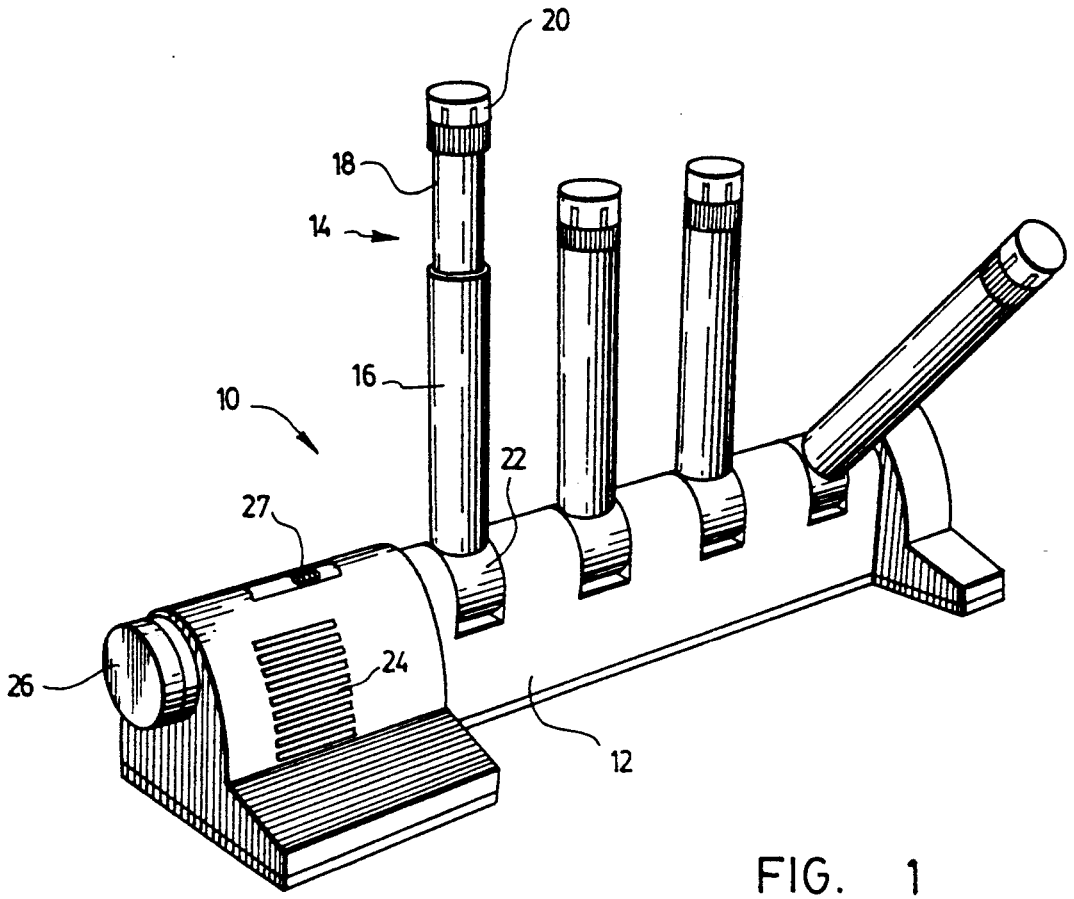
FIG. 1 is a perspective view of the preferred embodiment mounted on the floor.

As shown in FIG. 1, the footwear drying apparatus (10) comprises four air conducting tubes (14) pivotally connected to a base (12) with each tube (14) being independently angularly adjustable. Each tube (14) comprises a cylindrical socket (22), a first telescopic member (16), and a second telescopic tube member (18) slidable inside tube (16), and a cap (20) placed over the end of tube (18).

Figure 2:
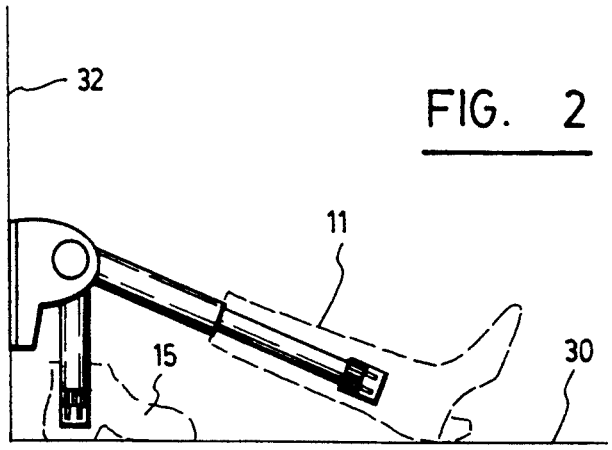
FIG. 2 is a side view of the preferred embodiment mounted to a wall.

In FIG. 1, apparatus (10) is floor mounted, and in FIG. 2 apparatus (10) is mounted to a wall (32). When mounted on the floor (30), one may place a shoe or boot over tubes (14) for drying, and it is recommended that the shoe or boot would be placed with the toe or heel resting on the floor with tube (14) inserted into the shoe or boot. In the case of wall mounting as shown in FIG. 2, a shoe (15) may be placed with its sole flat on the floor (30) and the nozzle (20) of tube (14) may be extended inside the shoe (15). This of course is most easily done by pulling tube (14) away from the wall (32), then inserting the nozzle into the shoe (15), and then pivoting tube (14) with shoe (15) back down towards the wall (32) until the shoe rests on the floor. The same procedure is undertaken with boot (11), except that tube (18) is fully extended with respect to tube (16), and then with the tube (14) projecting substantially horizontally from the wall (32), boot (11) is placed over tube (14) until the top leg portion of the boot (11) approaches base (12), and then the boot (11) and tube (14) are pivoted until the heel of boot (11) comes to rest on floor (30). In the case that the shoe (15) or boot (11) is covered with snow, a moisture collecting mat would usually be placed under the footwear. In the configuration of FIG. 2, it is possible to take any unused one of tubes (14) and orient it vertically (above horizontal) and place thereon a glove, mitten or sock that needs to be dried.

Apparatus (10) is controlled by a timer (26) which can set the apparatus to run for up to 120 minutes. A sliding heat control knob (27) can be used to adjust the heat from none (cool air) to maximum (hot air).

As shown in FIG. 3, the base (12) is made of a two-part plastic shell housing (40, 42) which forms four coaxial socket-like tube connectors (48) for receiving the cylindrical sockets (22) of tubes (14). The base includes an electric fan (44) and resistance heating element (46) for providing the hot air supply and a grating (24) is provided to allow cold dry air to enter the housing (12). By friction, the sockets (22) turn in their corresponding connectors (48) and may be maintained at an appropriate angle with respect to the base (12).

Figure 4:
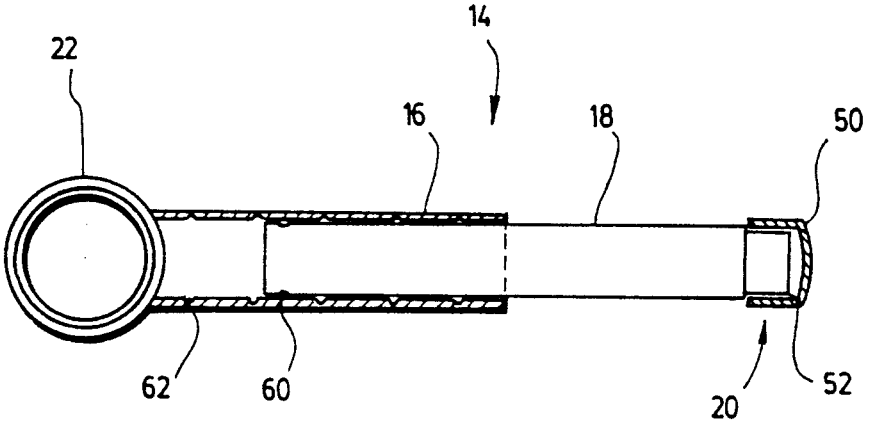
FIG. 4 is a longitudinal cross-sectional view of one air conducting tube according to the preferred embodiment.

As shown in FIG. 4, the tubes (14) are made up of the sockets (22) connected to and communicating air with a first telescopic outer tube (16) which receives a second inner telescopic tube (18). The outer tube (16) is provided with a number of annular grooves (62), and the second tube (18) is provided with an annular rib (60) which may lock into any one of the grooves (62). This arrangement also helps to keep an air tight seal between tubes (16) and (18). The nozzle (20) comprises a cap (50) which is rotatable about an end ring (52) connected to the end of second tube (18). As shown partly in FIG. 3 and in detail in FIGS. 5 and 6, the cap (50) is provided on one side with four slits (56) and on an opposite side to slits (58). The inner ring (52) is provided with two U-shaped indentations (54) which are large enough to overlap with either slits (56) or (58).

When cap (50) is rotated as shown in FIG. 5, more air is blown towards the toe of the footwear than to the heel. As can be appreciated, by turning the cap (50) 90° in one direction the air flow is cut off as shown in FIG. 6. And by turning the cap (50) through yet another 90°, the direction of the air flow would be reversed. Reversal of the air flow, gives the user control over whether air is to be directed mostly towards the heel or the toe, and also it allows one to place a shoe or boot to be dried on either side of base (12) when apparatus (10) is floor mounted, and in the case that apparatus (10) is wall mounted, it allows one to insert a boot onto tube (14) with the toe of the boot resting on floor (30) instead of the heel.

The nozzle air flow control is achieved by rotation of the cap member (50) of nozzle (20). The air flow of each nozzle can be controlled by rotation of the cap (50) for the purposes of directing more hot air into those items that need more drying air, and in the case that there are few items to be tried than there are tubes (14), the nozzle 20 may be turned off in order that no hot drying air is expended needlessly.

What is claimed is:

1. A footwear drying apparatus comprising:

a hot air supply;

a plurality of air conducting tubes connected to the hot air supply for conducting hot air into footwear; and a plurality of nozzles provided at ends of said tubes, said nozzles having at least two outlets substantially diametrically opposed for blowing air in a first direction towards a toe of the footwear and in a second opposite direction towards a heel of the footwear, said outlets providing substantially more air flow towards said toe than towards said heel, the nozzles each comprising a fixed member fixed with respect to said nozzles and an adjacent rotating member rotatable with respect to said tubes, said outlets being provided by an intersection of corresponding openings in each said fixed member and each said rotating member, rotation of said rotating member reducing said intersection to zero, whereby by rotating said rotating member of any one of said nozzles, air flow can be controlled from no air flow to maximum air flow.

2. Apparatus as claimed in claim 1, wherein said air conducting tubes are cylindrical, and said adjacent rotating member comprises a cap covering an end of each said tubes, said fixed member comprising the end of said tubes.

3. Apparatus as claimed in claim 2, wherein said openings in said rotating member comprise more than two slits for blowing air in said first direction and at least one slit for blowing air in said second direction.

4. Apparatus as claimed in claim 3, wherein said openings in said fixed members comprise U-shaped slots provided in ends of said tubes, said slots being large enough to accommodate said slits of either said first or said second direction, whereby said first and said second directions may be reversed by turning said cap.

5. Apparatus as claimed in claim 4, wherein said tubes are independently pivotally mounted to a base for pivoting about a common axis, and said slots are provided on sides of said tubes facing the direction of pivot.

6. Apparatus as claimed in claim 1, wherein said tubes are telescopically extendible.

7. Apparatus as claimed in claim wherein said tubes are independently pivotally mounted to a base.

8. Apparatus as claimed in claim 4, wherein said tubes are telescopically extendible.

9. Apparatus as claimed in claim 5, wherein said tubes are telescopically extendible.

10. A footwear drying apparatus comprising:

a hot air supply;

a base having a plurality of coaxial tube connectors connected to said supply; and a plurality of air conducting tubes independently pivotable about a common axis and each comprising a cylindrical socket pivotally connected to a corresponding one of said connectors to pivot about said common axis, a telescopic member extending perpendicularly with respect to said common axis and connected to and in communication with said socket, and an outlet nozzle connected to said telescopic member, said sockets being able to pivot through at least 90° , and said telescopic member of said tubes being able to be positioned substantially parallel to a bottom of said base;

whereby when the base is floor mounted, said tubes may be pivoted upwardly when not in use and substantially horizontally with said second telescopic member fully extended in the footwear with the footwear resting on the floor when in use, and when the base is wall mounted, said tubes may be pivoted toward the wall when not in use and may be pivoted away from the wall to place the footwear and then lowered with the footwear until the footwear rests on the floor when in use.

11. Apparatus as claimed in claim 10, wherein said outlet nozzles comprise air flow valve means to control the air flow from no air flow to a maximum air flow, whereby when fewer than all tubes are required, the valve means can be used to turn off the air flow and limit the air supply to those which are in use, and more air flow can be given to those tubes which have a more difficult drying task.

12. Apparatus as claimed in claim 10, wherein the base comprises a two-part housing separable about a plane passing through said common axis, whereby connection of said sockets to said tube connectors is effected by assembling said two-part housing.

13. Apparatus as claimed in claim 12, wherein said tubes are cylindrical.

14. A footwear drying apparatus comprising:

a hot air supply;

a base having a plurality of coaxial tube connectors connected to said supply;

a plurality of air conducting tubes independently pivotable about a common axis and each comprising a cylindrical socket pivotally connected to a corresponding one of said connectors, a telescopic member connected to said socket, and an outlet nozzle connected to said telescopic member, said outlet nozzles comprising air flow valve means to control the air flow from no air flow to a maximum air flow; and said outlet nozzle comprising a cylindrical cap placed over an annular ring solid with said telescopic member, said annular ring comprising diametrically opposed slots for allowing air to pass therethrough, and said cap comprising diametrically opposed slits, said slots being provided on sides of said tubes in a direction of their pivoting, whereby when the base is floor mounted, said tubes may be pivoted upwardly when not in use and substantially horizontally with said second telescopic member fully extended in the footwear with the footwear resting on the floor when in use, and when the base is wall mounted, said tubes may be pivoted toward the wall when not in use and may be pivoted away from the wall to place the footwear and then lowered with the footwear until the footwear rests on the floor when in use, when fewer than all tubes are required, the valve means can be used to turn off the air flow and limit the air supply to those which are in use, and more air flow can be given to those tubes which have a more difficult drying task, and by rotating the cap, air flow through said outlet nozzles may be controlled from no flow to a maximum air flow.

15. Apparatus as claimed in claim 14, wherein more slits are provided on one of said sides, whereby more air flow can be directed towards a toe of the footwear than towards a heel.

16. Apparatus as claimed in claim 7, wherein said base comprises a two-part housing separable about a plane passing through a pivot axis common to said tubes, whereby connection of said tubes to said base is effected by assembling said two-part housing.

* * * * *